US005277490A

United States Patent [19]

Boon

[11] Patent Number: 5,277,490

[45] Date of Patent: Jan. 11, 1994

[54] METHOD AND APPARATUS FOR PRODUCING BITUMINOUS MIXTURES

[75] Inventor: Arie J. Boon, Kerkdriel, Netherlands

[73] Assignee: Bitumarin B.V., Oplinen, Netherlands

[21] Appl. No.: 28,666

[22] Filed: Mar. 5, 1993

Related U.S. Application Data

[63] Continuation of Ser. No. 643,871, Dec. 20, 1990, abandoned.

[30] Foreign Application Priority Data

Dec. 21, 1989 [NL] Netherlands ..... 8903141

[51] Int. Cl.[5] ..... B28C 1/22

[52] U.S. Cl. ..... 366/4; 366/7; 366/22; 366/149

[58] Field of Search ..... 366/4, 7, 22, 23, 24, 366/25, 26, 144, 147, 149

[56] References Cited

U.S. PATENT DOCUMENTS

| | | | |
|---|---|---|---|
| 2,746,733 | 5/1956 | Edgerton | 366/4 |
| 3,305,138 | 2/1967 | Plumb | 366/25 |
| 3,378,171 | 4/1968 | Eaton | 366/22 |
| 3,381,943 | 5/1968 | Miller . | |
| 4,406,676 | 9/1983 | Potter . | |

FOREIGN PATENT DOCUMENTS

| | | |
|---|---|---|
| 0192300 | 8/1986 | European Pat. Off. . |
| 3341006 | 5/1985 | Fed. Rep. of Germany . |
| WO84/00377 | 2/1984 | World Int. Prop. O. . |

*Primary Examiner*—Robert W. Jenkins
*Attorney, Agent, or Firm*—Young & Thompson

[57] ABSTRACT

Method and apparatus for producing mixtures containing bitumen, in which the material to be treated is conveyed by the force of gravity through a slit-type space between two vertically arranged heated surfaces.

11 Claims, 1 Drawing Sheet

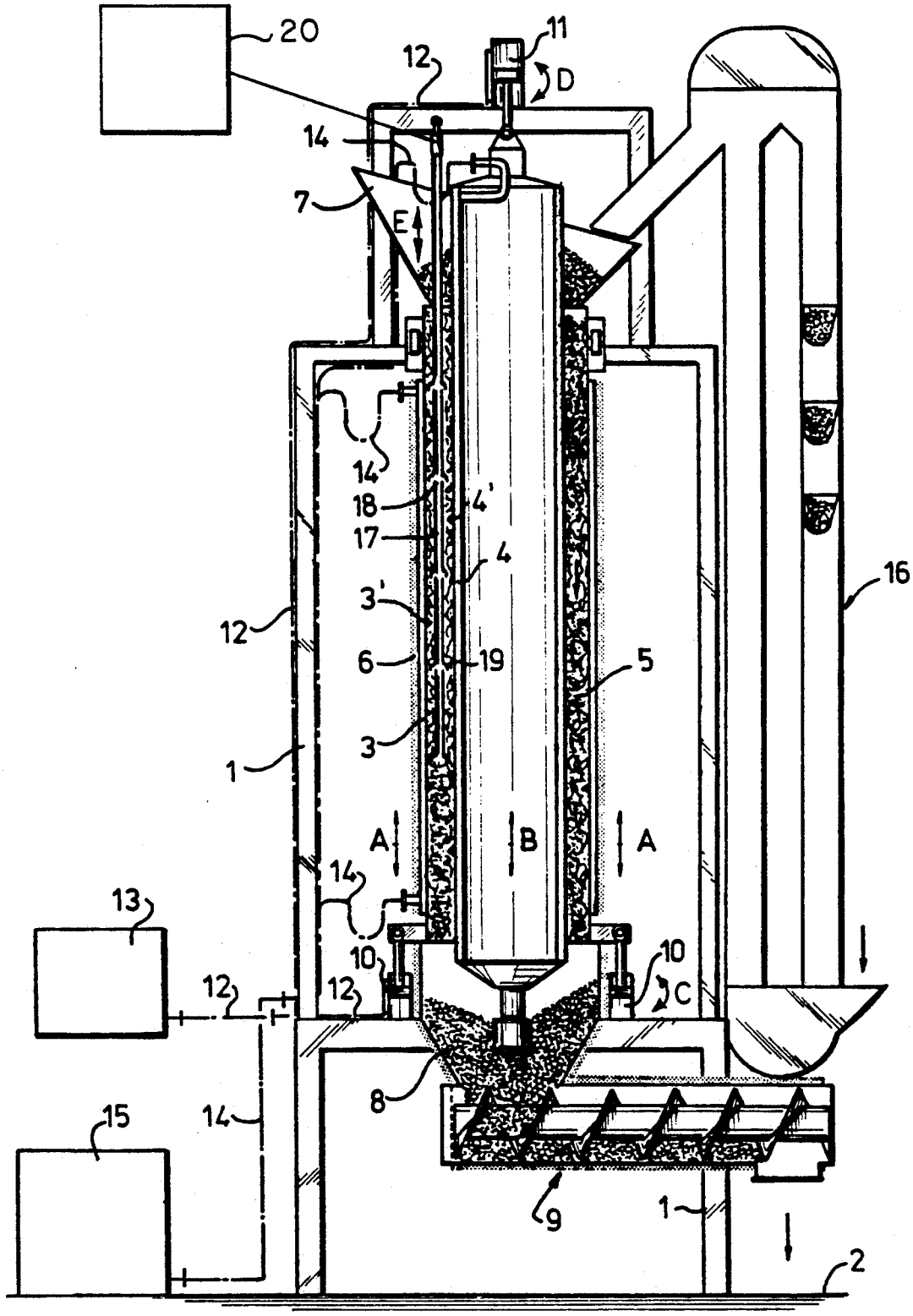
20
11
12
D
14
7
E
14
18
4'
17
4
3'
12
6
19
5
16
3
1
A
B
A
14
13
10
10
12
12
C
8
15
14
9
1
2

METHOD AND APPARATUS FOR PRODUCING BITUMINOUS MIXTURES

This application is a continuation of application Ser. No. 07/643,871, filed Dec. 20, 1990, now abandoned.

FIELD OF THE INVENTION

The invention relates to a method for producing mixtures containing bitumen, for example for use in road building and hydraulic engineering, in which the material to be treated is fed through a slit-type space between two heated surfaces. Such a method is known from European Patent Specification 0,192,300.

BACKGROUND OF THE INVENTION

In the known method, the materials to be treated are fed through a slit-type space which is bounded by the interior surface of a cylindrical external jacket and the exterior surface of a rotor rotating concentrically inside the jacket, the common axis of the jacket and the rotor extending horizontally. The rotor is caused to rotate in order to convey the material to be treated through the relatively narrow slit-type gap, ribs or upright studs or pins extending along a helix also preferably being provided on the exterior surface of the rotor.

The disadvantage of the known method is, firstly, that it is not possible or very difficult to ensure that the slit-type gap is always completely filled with the material to be treated, and secondly the conveyance through the slit-type gap proceeds very laboriously, as a result of which the efficiency of the method leaves something to be desired.

The object of the invention is to provide an improved method.

SUMMARY OF THE INVENTION

This object is achieved in that, in the method according to the invention, the material is conveyed by the force of gravity through the slit-type space because the heated surfaces have been arranged vertically and the material is fed into said space at the top of the slit-type space so that said material moves downwards under the influence of the force of gravity and emerges from the slit-type space at the bottom, the material preferably being mixed or stirred together during its movement through the slit-type space.

The invention is based on the insight that the width of the slit-type gap can be substantially greater than in the known method because, as a consequence of a combination of certain properties of the material to be treated, the heat transfer through the two heated surfaces is greater than the heat transfer which would be expected on the basis of experience. As a result of this substantially wider gap, the material can be fed through said space as a consequence of the force of gravity, said space being vertical, thus ensuring that said space is always completely filled with material. In order to obtain a favourable temperature gradient over the wider gap under these conditions, it may be necessary that, during the movement of the material through the slit-type space, it is mixed or stirred together.

The invention also relates to an apparatus for carrying out the method, comprising two surfaces forming the said surfaces, enclosing an annular gap and situated coaxially inside each other, means for heating said surfaces, a material feed near one end and a material discharge at the other end of the said space, the surfaces, according to the invention, being vertical and the material feed being provided at the top and the material discharge near the bottom of the annular gap, means for mixing together the material moving through the slit-type space being preferably provided in said space.

Preferably, the means for mixing together the material are formed by stud-like elements capable of moving up and down.

Advantageously, said stud-like elements can be provided on at least one of the surfaces, said surface being designed to be capable of moving up and down with respect to the other surface.

The studs may, however, also be provided on bodies extending through the gap and mounted so as to be capable of moving up and down.

Since during warming of the material moving through the annular gap steam is formed which has to be discharged for a proper course of the process, preferably at least one pipe is provided which hangs downwardly inside the annular gap which pipe is provided with orifices extending through the wall at different levels.

Advantageously U-shaped section pieces are fixed to the pipe at the locations of the orifices, which pieces cover said orifices with an interspace from the top so that the formed steam at first is collected by said section pieces to be discharged via said orifices in the pipe upwardly through said pipe.

The pipe may be mounted for up and down movement so that it can form also a body as mentioned hereinabove having elements for mixing together the material.

In order to promote the feeding of the material through the annular space, the surfaces can be designed to be capable of moving translationally and/or rotationally.

BRIEF DESCRIPTION OF THE DRAWING

The invention is explained in greater detail with reference to the drawing, which shows an embodiment of the apparatus according to the invention.

DETAILED DESCRIPTION OF THE INVENTION

As shown in the drawing, the apparatus comprises a supporting and guiding structure 1 which rests on a floor 2. Provided inside said structure 1 are a vertically positioned, cylindrical external jacket 3 of double-walled design and a cylindrical internal jacket 4 of double-walled design situated concentrically therein in a manner such that an annular gap 5 is formed between the jackets 3 and 4. The external jacket 3 is provided, on the outside, with a sleeve 6 of insulating material. Stud-like elements 3' are provided on the inside of the external jacket and stud-like elements 4' are provided on the outside of the internal jacket 4.

Provided at the upper end of the annular gap 5 is a filling hopper 7 for the material to be treated, while a collecting hopper 8 for the treated material, which opens into a discharge apparatus 9 for said treated material is present underneath said gap 5.

The external jacket 3 is provided with a hydraulic drive mechanism 10 and the internal jacket 4 is provided with a hydraulic drive mechanism 11. The external jacket 3 and the internal jacket 4 can be set in motion translationally by means of said mechanisms 10 and 11, as shown by the double arrows A and B. The mechanisms 10 and 11 may, however, be of a design such that the external jacket 3 and the internal jacket 4 can also be set in motion rotationally, as shown by the double arrows C and D. The power for the mechanisms 10 and 11 is delivered by the hydraulic pumping unit 13 via the lines 12.

Both the external jacket 3 of double-walled design and the internal jacket 4 of double-walled design are heated by passing a heating medium, for example thermal oil, through them, which medium is delivered by the heating and pumping unit 15 via the lines 14.

The drawing furthermore also shows a filling apparatus 16.

A number of pipes 17 for the discharge to the outside of steam hang downwardly inside the annular space 5, of which pipes only one is visible in the figure. At specific levels orifices 18 are provided through the wall of the pipe which are covered with an interspace from the top by U-shaped section pieces 19. Said pipes 17 may be mounted for up and down movement, as shown by double arrow E and drive means 20, so that they can also mix together the material to be treated.

When the apparatus is in operation, the material to be treated is fed via the filling apparatus 16 into the filling hopper 7, from which said material enters the annular space 5. Said material is conveyed through said space 5 under the influence of the force of gravity, said material being dried and heated respectively by means of the heated jackets 3 and 4, and the steam formed thereby being collected by the U-shaped section pieces 19 and being discharged via the orifices 18 through the pipes 17 to the outside where the steam may be permitted to condense. In order to facilitate the conveyance of the material, the jackets 3 and 4 may be set in motion translationally and/or rotationally by means of the associated drive mechanisms 10 and 11, the wall friction being compensated for thereby. At the same time, the material is thoroughly mixed or stirred by the presence of the studs 3', 4'. After leaving the space 5, the treated material is collected in the collecting hopper 8 and transported out of the latter via the discharge apparatus 9.

I claim:

1. Method for producing mixtures containing bitumen, for use in road building or hydraulic engineering, which comprises: conveying material to be treated to the top of an apparatus having two vertical and concentrically arranged heated jackets, said jackets defining an annular gap therebetween, each of said jackets being of double-walled design and being heated by passing a heating medium therethrough, and feeding said material into said annular gap so that said material moves downwardly under the influence of the force of gravity and emerges from the annular gap at the bottom.

2. Method according to claim 1, wherein the material is thoroughly mixed or stirred during its movement through the annular gap.

3. Apparatus for producing mixtures containing bitumen, for use in road building or hydraulic engineering, comprising: a top, a bottom, two vertically arranged jackets, situated coaxially inside each other, and enclosing an annular gap, each jacket being of a double-walled design and including means for passing a heating medium therethrough, a material feed provided at the top of the annular gap, and a material discharge provided at the bottom of said annular gap.

4. Apparatus according to claim 3, wherein said annular gap includes means for mixing the material moving through said gap.

5. Apparatus according to claim 4, wherein the means for mixing the material are formed by stud-like elements.

6. Apparatus according to claim 5, wherein the stud-like elements are provided on at least one of the jackets, said at least one jacket including means for moving it up and down with respect to the other jacket.

7. Apparatus according to claim 5, wherein the stud-like elements are mounted on bodies extending through the annular gap, and include means for moving them up and down.

8. Apparatus according to claim 3, wherein said annular gap includes at least one pipe for discharging steam to the outside, said pipe being provided at different levels with orifices extending therethrough.

9. Apparatus according to claim 8, wherein U-shaped section pieces are fixed to the pipe at the locations of the orifices, said pieces covering said orifices with an interspace from the top.

10. Apparatus according to claim 8, wherein said pipe includes means for moving it up and down.

11. Apparatus according to claim 3, wherein at least one of said jackets includes means for moving it up and down in the vertical direction.

* * * * *